United States Patent [19]

Bhattacharya

[11] 4,199,701

[45] Apr. 22, 1980

[54] FILL GAS FOR MINIATURE HIGH PRESSURE METAL VAPOR ARC LAMP

[75] Inventor: Ashok K. Bhattacharya, Lyndhurst, Ohio

[73] Assignee: General Electric Company, Schenectady, N.Y.

[21] Appl. No.: 932,514

[22] Filed: Aug. 10, 1978

[51] Int. Cl.[2] ..... H01J 61/16; H01J 61/20; H01J 61/52

[52] U.S. Cl. ..... 313/25; 313/225; 313/226; 313/229; 313/185

[58] Field of Search ..... 313/229, 226, 185, 184, 313/225, 25

[56] References Cited

U.S. PATENT DOCUMENTS

| | | | |
|---|---|---|---|
| 3,351,798 | 11/1967 | Bauer | 313/185 X |
| 3,753,018 | 8/1973 | Beijer et al. | 313/229 X |
| 3,814,971 | 6/1974 | Bhattacharya | 313/226 |
| 3,900,753 | 8/1975 | Richardson | 313/229 X |
| 3,937,996 | 2/1976 | Cap | 313/229 X |
| 3,974,410 | 8/1976 | Collins et al. | 313/229 X |
| 4,020,377 | 4/1977 | Popp et al. | 313/229 X |

FOREIGN PATENT DOCUMENTS 762479 11/1956 United Kingdom .

*Primary Examiner*—Palmer C. Demeo

*Attorney, Agent, or Firm*—Ernest W. Legree; Lawrence R. Kempton

[57] ABSTRACT

Miniature metal vapor arc lamps containing mercury and one or more metal halides are subject to severe blackening of the arc tube and poor lumen maintenance unless a high pressure of starting gas is used. A Penning mixture of neon admixed with 0.01 to 10% argon, krypton or xenon at a fill pressure from about 100 to 200 torr provides lower starting voltage together with better lumen maintenance than can be achieved with the conventional argon starting gas.

7 Claims, 2 Drawing Figures

FILL GAS FOR MINIATURE HIGH PRESSURE METAL VAPOR ARC LAMP

The invention relates to the starting gas mixture in high pressure metal vapor discharge lamps with particular reference to discharge lamps having very small volumes such as about 1 cubic centimeter and less.

BACKGROUND OF THE INVENTION

In order to reduce the voltage necessary for starting the discharge in metal vapor arc lamps, there is generally included an inert starting gas at a relatively low pressure. For instance, in the case of mercury vapor lamps and metal halide lamps which also contain mercury, the starting gas commonly used in commercially available lamps is argon at a pressure from 20 to 40 torr.

In the miniature metal vapor lamps with which the invention is particularly concerned, the small internal surface area of the arc tube entails rapid blackening should there be any electrode sputtering during operation of the lamp. Sputtering tends to occur at starting during the glow to arc transition (GAT) phase and thus it becomes important to shorten as much as possible the duration of the GAT. It is well-known to shorten the GAT by increasing the fill pressure of the starting gas but this also causes the starting voltage to increase. For instance a miniature metal halide lamp using argon for the starting gas at a fill pressure of 60 torr has a starting voltage in excess of 600 volts. The small arc tube blackens too rapidly with the result that the lamp has poor lumen maintenance. Increasing the fill pressure to 100 torr reduces the blackening but causes the starting voltage to increase to about 700 volts. In order to adequately suppress arc tube blackening due to sputtering of electrodes during lamp starting, the fill pressure of the starting gas should be increased into the range of 100 to 200 torr. However the starting voltage for a lamp with such a high argon pressure would be about 1,000 volts and this of course means that a high cost ballast would be required to start and operate the lamp.

SUMMARY OF THE INVENTION

The object of the invention is to provide a metal vapor arc lamp starting gas combination which is more effective as regards the desiderata of low starting voltage and good lumen maintenance.

I have found that a mixture of neon with a small percentage of one of the heavier inert rare gases makes a better starting gas for miniature metal vapor lamps than argon alone because at the relatively high fill pressures desirable to prevent arc tube blackening, this combination has a lower starting voltage than the conventionally used argon. Lamps corresponding to the example mentioned earlier when filled with neon plus 0.8% argon to fill pressures as high as 200 torr start at less than 550 volts. The lumen maintenance of these lamps is decidedly better than that of corresponding lamps using argon for the starting gas. Also the starting voltage in a neon-plus-heavier-inert-rare-gas mixture is less affected by the presence of impurities.

In accordance with the invention, neon admixed with 0.01 to 10% argon, krypton or xenon at a total pressure of 100 to 400 torr is provided as the starting gas for miniature metal vapor lamps such as lamps of less than 1 cc volume containing mercury and one or more metal halides; the range of 100 to 200 torr is preferred for lamps of less than 1 cc volume intended for general lighting use.

DETAILED DESCRIPTION

Figure 1:
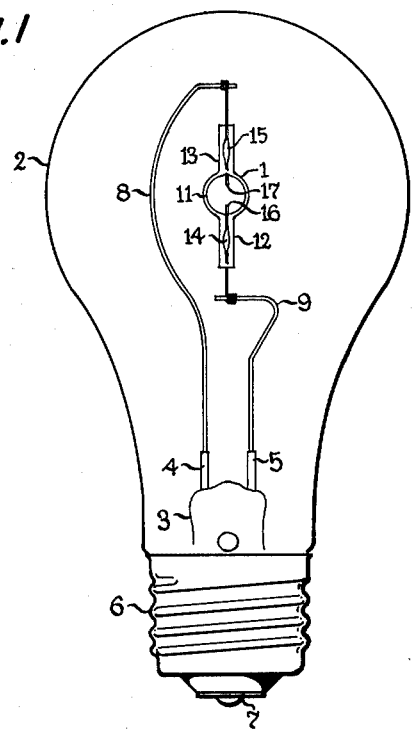
FIG. 1 illustrates a jacketed miniature metal halide lamp of about 30 watts rating in which the invention may be embodied.

The invention is particularly useful for miniature metal halide arc lamps such as those described in copending application Ser. No. 912,628, filed June 5, 1978 by Daniel M. Cap and William H. Lake, titled High Pressure Metal Vapor Discharge Lamps of Improved Efficacy and assigned like this application. Referring to FIG. 1, such a lamp may comprise a small arc tube 1, generally less than 1 cc in volume, supported within an outer glass envelope or jacket 2. The outer envelope is provided at its lower end with a reentrant stem 3 through which extend lead-in wires 4,5 having connections to the electrical contacts of a base, suitably the threaded shell 6 and the end contact 7.

The small arc tube is suspended within the outer jacket between hoop-like support 8 and short support 9 which are welded to the lead-in wires 4,5. It is made of quartz or fused silica and comprises a central bulb portion 11 which may be formed by the expansion of quartz tubing, and neck portions 12,13 formed by collapsing or vacuum sealing the tubing upon foliated molybdenum inleads 14,15. Pin-like electrode 16,17 of tungsten are welded to the molybdenum inleads and project axially into the envelope with their distal ends defining the arc gap. A suitable filling for the envelope comprises a starting gas, mercury, and one or more metal halides, for instance sodium iodide, scandium triiodide, and thorium tetraiodide. By way of example, a 30-watt lamp such as illustrated may have an outer diameter of 0.7 cm, a volume of 0.11 $cm^3$, an arc length of 0.3 cm and a filling comprising 4.3 mg of Hg, and 2.2 mg of halide salt consisting of 85% NaI, 5% $ScI_3$ and 10% $ThI_4$ by weight. The mercury density during operation is about 39 $mg/cm^3$ which corresponds to a pressure of about 23 atmospheres.

Figure 2:
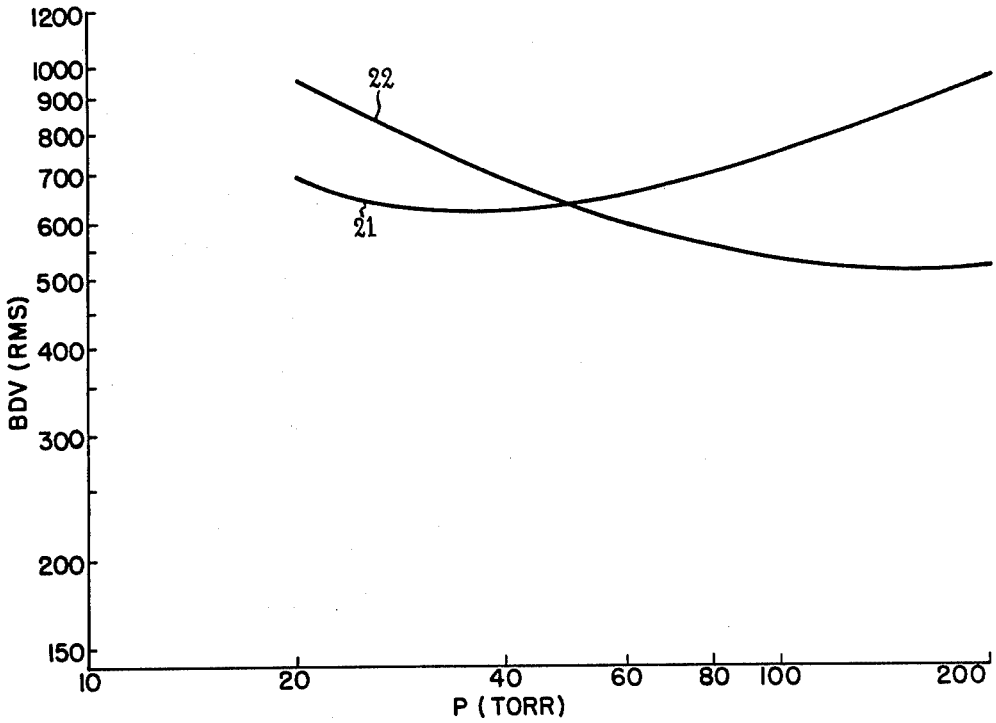
FIG. 2 is a plot of the variation of breakdown voltage with fill gas pressure when neon plus a small percentage of argon is used for the starting gas compared with the conventional use of argon.

FIG. 2 shows the variation in breakdown voltage with fill gas pressure for this particular lamp, curve 21 for the conventional argon fill, and curve 22 for a fill of neon plus 0.8% argon in accordance with the invention. The breakdown voltage was taken as the potential difference (peak volts) between the two electrodes at which a low current visible glow discharge was established in the electrode gap. Measurements were taken in air at room temperature without any jacket surrounding the arc tube. After each light-up, the lamp under investigation was burned vertically at 30 watts and frequency of 25 kilohertz for 5 to 10 minutes. In most lamps, the breakdown voltage for the first light-up was much higher than subsequent values and for this reason was omitted in the analysis of the data. Curves 21 and 22 are plots of the mean for 5 readings after the initial light-up.

From curve 21 it is observed that when argon is used for the starting gas, the lowest breakdown voltage occurs in the range of 20 to 40 torr, and above 40 torr the breakdown voltage rises fairly rapidly. The broad minimum in the curve shows the Penning effect, in which metastable atoms ionize atoms of another species. When argon is used for the starting gas, the metastable atoms are argon and they ionize the mercury atoms present in vapor form. When the lamp is not operating, since there is condensed mercury present, the density of the mercury vapor is determined by the lamp temperature, while the density of argon atoms is determined by the fill pressure. As the fill pressure is increased, the proportion of mercury atoms available for ionization falls with the result that the breakdown voltage rises.

When neon with a low proportion of one of the heavier inert gases argon, krypton or xenon is used for the starting gas mixture, the Penning effect is again present. In this case the metastable atoms are neon atoms and they ionize argon atoms (or krypton or xenon). When now the fill pressure is increased, the proportion of argon to neon does not change. For this reason the rise in breakdown voltage which eventually sets in as the fill pressure is increased more and more, happens much later in the pressure scale. A pressure in excess of 100 torr is desirable in order to minimize sputtering and the resulting envelope darkening in these miniature lamps. For the pressure range from 100 to 200 torr, the breakdown voltage with the neon plus 0.8% argon mixture is lower by anywhere from 300 to 500 volts than with the conventional argon mixture; beyond 200 torr up to 400 torr, the breakdown voltage rises slowly but it remains lower by at least 500 volts than that of argon at the same pressure. In a test of a large group of lamps filled with Ne plus 0.8% Ar at 200 torr, the starting or breakdown voltage was under 600 volts. Thus the starting voltage of these lamps was lower than can be achieved with the conventional argon fill and the lumen maintenance was superior. Fill pressures above 200 torr may be used in order to further diminish sputtering at starting, but the starting voltage becomes higher.

Neon admixed with 0.01 to 10% Ar, Kr or Xe at a total pressure of 40 to 200 torr is desirable for miniature metal vapor lamps, in particular miniature metal halide lamps having envelope volumes of 1 cc or less. The advantages of using such a gas mixture are low starting voltage, starting voltage independent of the ambient temperature, better lumen maintenance because a higher fill pressure is permissible, and easier hot restart.

Since neon diffuses slowly through quartz, the partial pressure of neon in the arc tube may decrease during the life of the lamp. Such reduction in neon pressure may change the starting voltage and may also have an undesirable effect on the lumen maintenance of the lamp at a time later in its life. This undesirable effect may be avoided by providing an appreciable partial pressure of neon in the interenvelope space that is in the jacket of the lamp. For instance the outer envelope 2 may be filled with a mixture of neon admixed with 1 to 20% of nitrogen at less than atmospheric pressure. When a starting mixture having a fill pressure above 200 torr is used, the pressure of neon required in the outer envelope to prevent diffusion loss of neon from the arc tube may exceed atmospheric pressure during lamp operation. This may be considered hazardous in lamps for general use using thin-walled outer envelopes of inexpensive lime glass. For this reason, a starting mixture fill pressure in the range from 100 to 200 torr is preferred.

What I claim as new and desire to secure by Letters Patent of the United States is:

1. A metal vapor arc lamp comprising a miniature arc tube containing mercury and one or more metal halides plus a starting gas which must be at a relatively high fill pressure in order to avoid severe blackening of the arc tube and poor lumen maintenance, characterized by the presence therein of a Penning starting gas mixture of neon admixed with 0.01 to 10% argon, krypton or xenon at a fill pressure above 100 and up to 400 torr.

2. A lamp as in claim 1 wherein the metal halides comprise sodium iodide, scandium triiodide and thorium tetraiodide.

3. A lamp as in claim 1 wherein the arc tube volume is less than 1 cc.

4. A lamp as in claim 1 wherein the arc tube volume is less than 1 cc and wherein the fill pressure of the starting gas mixture is above 100 and up to 200 torr.

5. A lamp as in claim 4 wherein the metal halides comprise sodium iodide, scandium triiodide and thorium tetraiodide.

6. A lamp as in claim 1 including an outer envelope surrounding the arc tube and containing neon at an appreciable partial pressure in order to reduce loss of neon from the arc tube by diffusion.

7. A lamp as in claim 6 wherein the outer envelope contains neon and 1 to 20% nitrogen at less than atmospheric pressure.

* * * * *